United States Patent [19]

Jackson

[11] 3,945,341

[45] Mar. 23, 1976

[54] DYE GUN MARKER

[76] Inventor: George R. Jackson, Star Rte. Box 127, Midkiff, Tex. 79755

[22] Filed: Aug. 27, 1974

[21] Appl. No.: 500,851

[52] U.S. Cl. ..... 118/7; 43/84; 118/300; 118/3

[51] Int. Cl.[2] ..... B05C 5/00; B05C 11/00

[58] Field of Search ..... 118/2, 3, 7, 8, 300; 43/84; 116/83, 98

[56] References Cited

UNITED STATES PATENTS

| | | | |
|---|---|---|---|
| 2,624,148 | 1/1953 | Graybill | 43/84 |
| 2,654,178 | 10/1953 | Graybill | 43/84 |
| 2,731,937 | 1/1956 | Rhodes | 116/98 |
| 3,214,857 | 11/1965 | Tyrone et al. | 118/2 |
| 3,340,645 | 9/1967 | Poteet | 43/84 |
| 3,614,940 | 10/1971 | Abrams et al. | 118/3 |
| 3,695,216 | 10/1972 | Abrams et al. | 118/3 |

*Primary Examiner*—Mervin Stein
*Assistant Examiner*—Douglas Salser
*Attorney, Agent, or Firm*—Marcus L. Bates

[57] ABSTRACT

A marker device for ejecting a chemical marking substance, such as paint, onto nearby unauthorized persons or objects, comprising a chamber means for containing an isolated quantity of a chemical marking substance therein. The chamber is attached to a main body member. The main body contains an evacuating plunger means therewithin which is movable from a retracted into an extended position and which is telescopingly received within the chamber when moved into the extended position.

A power mechanism which can be actuated to move the plunger along its longitudinal axis is incorporated within the main body along with a trigger mechanism for actuating the power mechanism, so that when triggered by unauthorized persons, the plunger forces the chemical marking substances to be ejected and dispersed in a selected direction.

3 Claims, 7 Drawing Figures

DYE GUN MARKER

BACKGROUND OF THE INVENTION

Most trespassers can be classified as either vandals or thieves. Trepassers in general are responsible for a considerable amount of waste in this country. Ranchers and farmers must set aside a substantial amount of their income each year in order to repair the damage caused by unauthorized persons entering their property and either deliberately or inadvertently causing harm to growing crops or to livestock. Ranchers and farmers own private roadways and trails which are primitive in nature, but nevertheless, are subject to unlawful use by unauthorized persons including thieves and vandals.

Often a trespasser can be apprehended only after he has removed himself and his vehicle from the property which he has damaged, thereby making it difficult for any law enforcement officer to prosecute the guilty party. This lack of proof or evidence encourages the malicious tresspasser. Accordingly, it is desirable to have made available a dye gun marker apparatus which is triggered when one comes in close proximity thereof, whereupon the person or vehicle is marked with a suitable chemical marking substance, as for example, water soluble paint. This expedient offers irrefutable evidence that the trespasser was in close proximity to the marker device.

THE PRIOR ART

Reference is made to the following patents to show known apparatus which are similar to the present invention:

| | |
|---|---|
| Poteet 3,340,645 | Rhodes 2,731,937 |
| Marlman 2,145,488 | Marlman 3,391,483 |

SUMMARY OF THE INVENTION

A marker device for ejecting a chemical marking substance onto nearby objects comprising a chamber means for containing an isolated quantity of chemical marking substance therein, and further providing expansible means which can be activated for causing the chemical substance to be evacuated therefrom with sufficient force to contaminate nearby objects positioned several feet away therefrom. The expansible means is an evacuating plunger means movable from a retracted into an extended position and telescopingly received within said chamber when moved into the extended position.

A power mechanism which stores energy is actuatable to move the plunger along its longitudinal axis when released by a trigger mechanism. The trigger mechanism can actuate the power mechanism at a spaced location therefrom.

Accordingly, a primary object of the present invention is the provision of a dye marker apparatus for ejecting chemical substance onto nearby objects for identification purposes.

A further object is the provision of a marker device having a chamber means within which a chemical substance is isolated and stored until an object moving nearby actuates a mechanism for evacuating the substance from the chamber thereby causing the chemical substance to be dispersed and contact the nearby object.

Another object of the invention is the provision of mechanism actuatable by an object moving into close proximity thereof which ejects a chemical substance onto the object to enable subsequent identification.

A still further object of the invention is to provide a marker device actuatable remotely for marking nearby objects.

The above objects are attained in accordance with the present invention by the provision of apparatus fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE EMBODIMENTS

Figure 1:
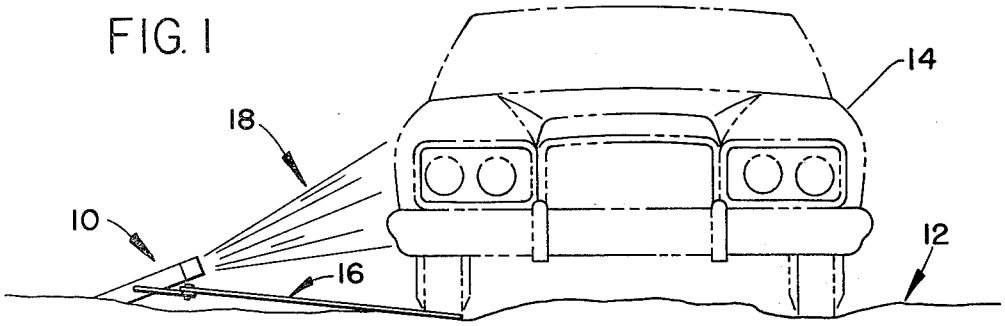
FIG. 1 is a part schematical, part diagrammatical, side elevational view illustrating the present invention in one of its operative configurations.

In FIG. 1 the invention 10 is operatively disposed relative to a primitive road 12 upon which an unauthorized vehicle 14 is traveling. Actuating lever 16 has been contacted by one of the wheels of the vehicle; and accordingly, a chemical marking substance contained within the apparatus 10 has been expelled as illustrated at 18 to thereby mark the vehicle.

Figure 2:
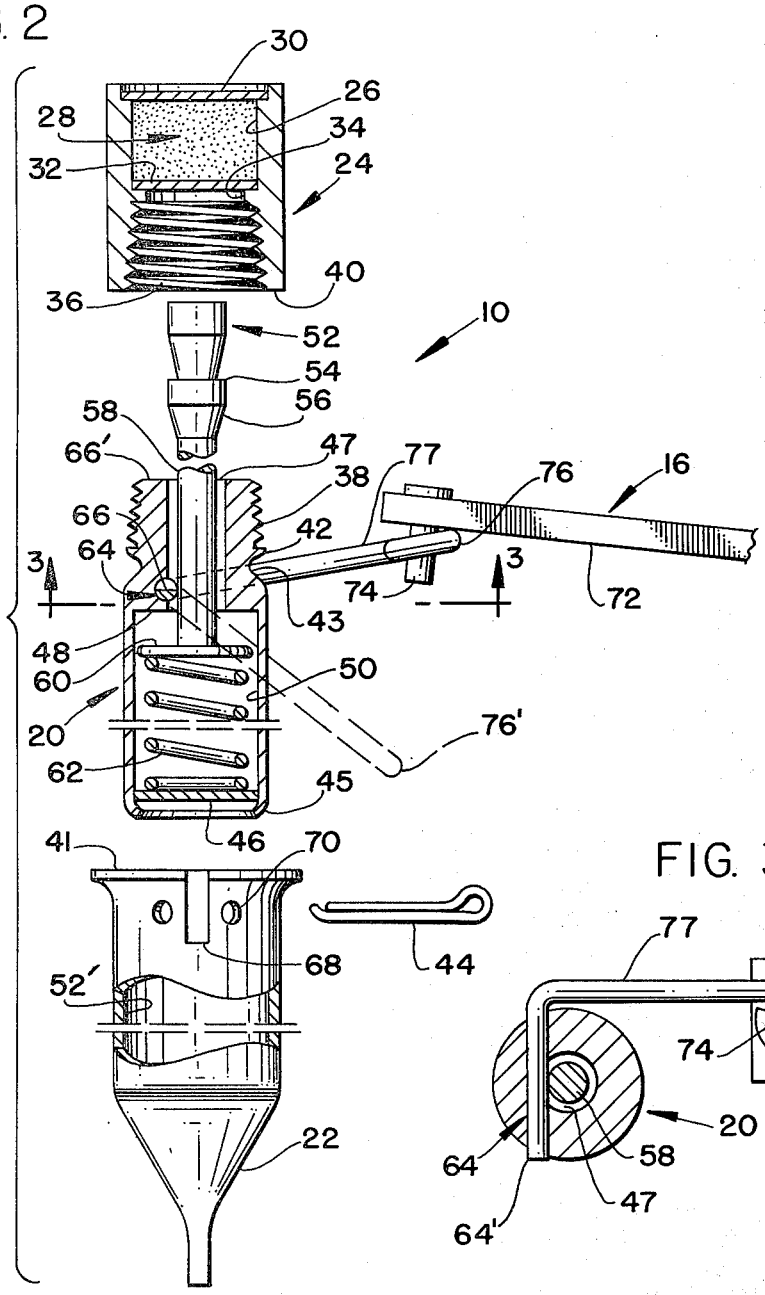
FIG. 2 is an enlarged, exploded, fragmentary, broken, part cross-sectional view of the present invention.
Figure 3:
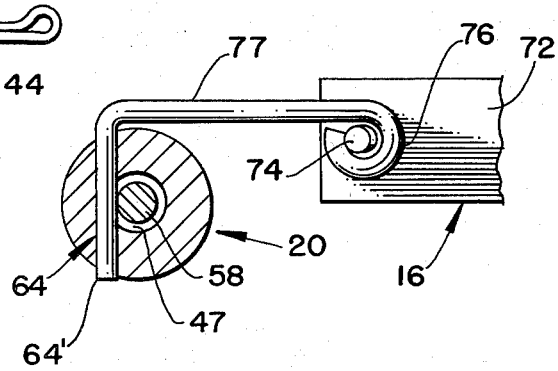
FIG. 3 is a broken, part cross-sectional view taken along line 3—3 of FIG. 2.

As seen in FIG. 2, the apparatus 10 comprises a main body 20, to which there is affixed a lower ground engaging member 22, and a removable chemical container 24. The chemical container has an interial wall surface 26 which forms a chamber 28 for storing chemical marking substance therein. The upper extremity of the container is sealed with a movable lid 30 which is sealed in seating engagement with the illustrated recess. The lower extremity of the chamber is sealed by a movable piston 32 which abuttingly engages a circumferentially extending shoulder 34. A female threaded surface area 36 threadedly engages a male threaded surface area 38 of the main body, while the annular area 40 abuttingly engages shoulder 42 located above neck 43 of the main body.

A marginal intermediate length of a cotter key 44 engages the neck, to releasably affix the main body to the ground engaging member, as will be more fully appreciated later on in this disclosure. The main body member includes a downwardly opening circumferentially extending skirt member which is inturned at 45 for capturing a disk 46 therewithin. Plunger passageway 47 is axially aligned with the skirt and disk. The passageway enlarges at shoulder 48 to define a power mechanism storage chamber having an inside peripheral wall surface 50, which reciprocatingly receives a lower marginal end portion of a plunger 52 therewithin.

The plunger has a circumferentially extending triggering shoulder 54 extending outwardly therefrom, and downwardly tapers at 56 into a constant diameter shaft portion 58 which terminates in an enlarged spring engaging disk 60. Spring 62 is compressed between the spaced upper and lower disks and forms a means by which energy can be stored within the chamber.

A trigger mechanism 64 is connected for actuating the power mechanism, and has a longitudinally extending shaft having a cutout 66 formed along a marginal length thereof which is complementary respective to the curvature of the shoulder 54 so that when the shaft is axially rotated, the shoulder 54 can be moved past the cutout of the trigger. The trigger has a free end portion 64' extending through the main body, and another portion which extends away from the main body.

Shoulder 66' defines the upper extremity of the main body. The upwardly opening slot 68 extends between and below a pair of spaced apertures 70 so that when the main body member is placed within the ground engaging member, the cotter key can be placed within the apertures 70, thereby loosely attaching the main body to the ground engaging member in a releasable manner.

The trigger mechanism includes an elongated thin member 72, such as a conventional dull colored wooden yard stick, which is provided with a pin or nail 74 at one end thereof. The pin is loosely received within loop 76 of the trigger shaft extension 77.

In operation, the plunger is moved against the compression spring until the shoulder of the enlargement clears the cutout of the trigger shaft, whereupon the lever 77 is then moved into the illustrated position of FIG. 2, thereby locking the enlargement at 54 so that the plunger is captured but at the same time biased in an outward direction. Movement of the trigger lever into the dot-dashed configuration seen at 76' will release the stored energy causing the plunger to move in an outward direction, and into the chamber.

Movement of the plunger into the chamber causes the piston 32 to rupture or otherwise uncover end 30 of the chamber, whereupon the chemical contained therein is forcibly directed away from the gun.

Figure 5:
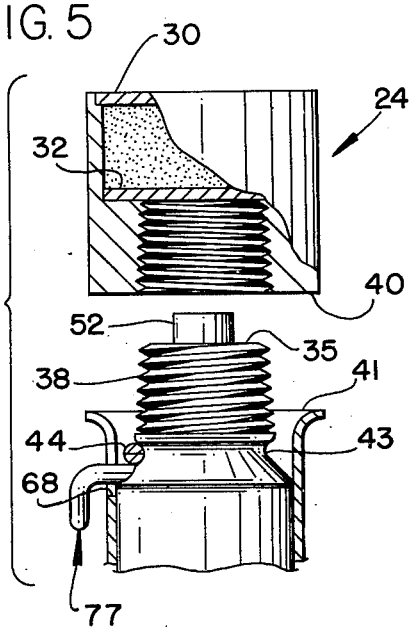
FIG. 5 is a partially exploded, fragmentary, part cross-sectional side view of the apparatus disclosed in the foregoing figures.
Figure 4:
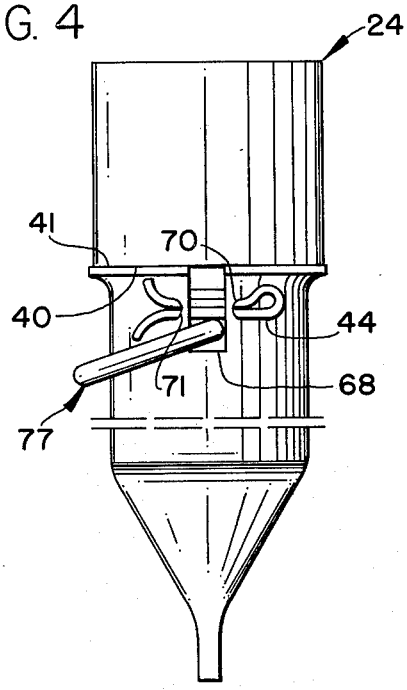
FIG. 4 is an assembled side elevational view of the apparatus disclosed in the foregoing figures.

As best seen in FIGS. 4 and 5, shoulder 40 of the chemical container 24 abutingly engages the circumferentially extending upper terminal end 41 of the ground engaging member. This causes the neck 43 of the main body member to bear against cotter pin 44, thereby releasably affixing the container, main body, and ground engaging member to one another. The trigger lever 77 freely extends through the lower portion of the slot in underlying relation to the cotter pin.

Figure 6:
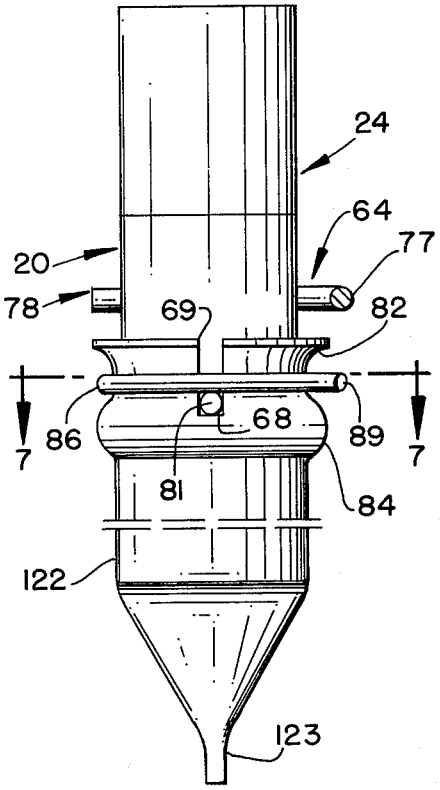
FIG. 6 is a side elevational view of a modification of the apparatus disclosed in the foregoing figures; and, FIG. 7 is a cross-sectional view taken along line 7—7 of FIG. 6.
Figure 7:
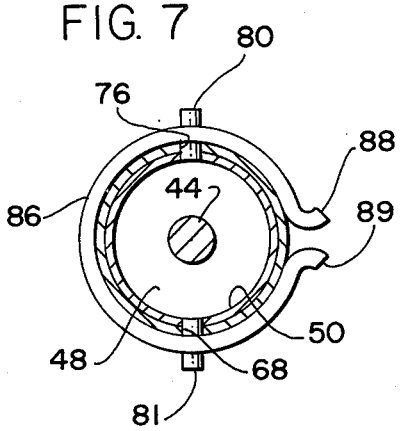

In the embodiment illustrated in FIGS. 6 and 7, the main body 20 is provided with diametrically opposed outwardly directed pins 80 and 81 which are of a size to be snuggly fitted within diametrically opposed slots 68 and 76. The slots each have opposed side walls which upwardly opens at 69.

The ground engaging member 122 has an outward projection 84 and an outwardly flared marginal free end 82, thereby leaving a minimum diameter portion which receives a split spring or keeper 86 thereabout. The split spring has terminal end portions 88 and 89 outwardly directed to enable engagement therewith so that the diameter of the spring can be momentarily forcibly increased to facilitate removal from the flared portion of the ground engaging member.

In operation of the second embodiment, the ground engaging member is driven into the ground, after which the main body of the gun is placed into the ground engaging member with the opposed pins 80 and 81 registering within the complementary formed opposed slots, after which the keeper spring is placed into the illustrated position of FIGS. 6 and 7. The sloped portion formed between 82 and 84 causes the keeper spring to be biased against the opposed pins with the pins abutting the lowermost portion of the slot 68 and 76, thereby removably attaching the main body portion to the ground engaging portion. The lever 77 is actuated as in the before described manner of the first embodiment.

Accordingly, the marker device of the present invention can be used for ejecting chemical 18 onto nearby objects 14 by the provision of chamber means 28 for containing an isolated quantity of chemical marking substance therein. An evacuating plunger means 52 is movable from a retracted into an extended position and is telescopingly received within the chamber when moved into the extended position. A power mechanism 60 and 62 can be actuated by the trigger means 16 and 64 to move the plunger along its longitudinal axis and into the chamber, thereby expelling the chemical therefrom. The trigger mechanism preferably is remotely actuated by member 16 when the nearby object comes in close proximity thereto.

I claim:

1. A marker device for ejecting chemical marking substance onto nearby objects comprising:

a main body having a chamber means formed therein for containing an isolated quantity of chemical marking substance therein;

a ground engaging member comprising an outwardly flared tubing having an upwardly opening slot formed therein;

a marginal portion of said main body being received within said ground engaging member and having a pin located thereon which is received within said slot, a spring member received about said tubing in a position to bias said pin toward the closed end of said slot;

an evacuating plunger means movable from a retracted into an extended position and telescopingly received within said chamber when moved into the extended position;

a power mechanism which can be actuated to move the plunger along its longitudinal axis;

a trigger mechanism for actuating said power mechanism;

and means for remotely actuating the trigger in response to movement of an object into contact therewith.

2. A marker device for ejecting chemical marking substance onto nearby objects, comprising, a main body having opposed end portions and an axial passageway formed therethrough, a chamber means removably affixed to one end portion of said main body, and a ground engaging member removably affixed to the remaining end portion of said main body in aligned relationship respective to said chamber;

said chamber means adapted to contain an isolated quantity of chemical marking substance therein;

an evacuating plunger means movable from a retracted into an extended position and telescopingly received within said chamber means when moved into the extended position;

a power mechanism which can be actuated to move said plunger along its longitudinal axis;

a trigger mechanism for actuating said power mechanism;

means connected to said trigger mechanism for actuating the power mechanism in response to movement of an object to be marked;

said plunger means having opposed ends and spaced enlargements formed thereon, said main body having a closure means at one end thereof, said power mechanism including a spring compressed between said closure means and one end of said plunger means;

said trigger mechanism releasably engaging said plunger means at a location between said enlargements when the plunger means is moved to said retracted position, and releasing said plunger means when said trigger mechanism is actuated, thereby enabling the power mechanism to move the plunger means into the extended position;

said means connected to said trigger mechanism being an elongated member having opposed end portions with one end portion being connected to move said trigger mechanism while the remaining end portion thereof is disposed away from said main body so that when sufficient force is placed upon the last said member, the trigger mechanism moves, causing the plunger means to move to the extended position.

3. A marker device for ejecting chemical marking substance onto nearby objects comprising:

chamber means for containing an isolated quantity of chemical marking substance therein; a ground engaging member, a main body member, means by which said main body member is removably affixed to said ground engaging member; said chamber means being affixed to said main body member;

an evacuating plunger means movable from a retracted into an extended position and telescopingly received within said chamber means when moved into the extended position;

a power mechanism which can be actuated to cause said plunger means to move along its longitudinal axis;

a trigger mechanism for actuating said power mechanism; means for actuating the trigger mechanism in response to movement of an object to be marked into contact therewith;

said ground engaging member having an outwardly directed flange, an upwardly opening slot, and opposed apertures formed in underlying relationship respective to said flange, and with said slot being located therebetween;

an outwardly directed annular shoulder formed on said main body member in underlying relationship to said chamber means for engagement with said ground engaging member;

a fastener means received through said apertures and placed into engagement with said annular shoulder, with said annular shoulder bearing against said fastener means so that said chamber, main body, and ground engaging member are releasably attached to one another.

* * * * *